United States Patent [19]

DeCloux

[11] Patent Number: 4,685,666

[45] Date of Patent: Aug. 11, 1987

[54] CLIMBING SIMULATION EXERCISE DEVICE

[76] Inventor: Richard J. DeCloux, 1485 Belmont St., Manchester, N.H. 03104

[21] Appl. No.: 644,389

[22] Filed: Aug. 27, 1984

[51] Int. Cl.[4] ..... A63B 23/04; A63B 21/00

[52] U.S. Cl. ..... 272/70; 272/130

[58] Field of Search ..... 272/70, 130, DIG. 9, 272/72

[56] References Cited

U.S. PATENT DOCUMENTS

| | | | |
|---|---|---|---|
| 2,079,594 | 5/1937 | Clem | 272/70 X |
| 3,529,474 | 9/1970 | Olson et al. | 272/130 X |
| 3,758,112 | 9/1973 | Crum et al. | 272/130 |
| 3,970,302 | 7/1976 | McFee | 272/70 X |
| 4,480,832 | 11/1984 | Bulmash et al. | 272/130 |
| 4,496,147 | 1/1985 | DeCloux et al. | 272/70 X |

*Primary Examiner*—Robert A. Hafer
*Assistant Examiner*—Kathleen J. D'Arrigo
*Attorney, Agent, or Firm*—Weingarten, Schurgin, Gagnebin & Hayes

[57] ABSTRACT

A trackless climbing simulation exercise device comprising an inclined plane, a pair of interconnected hydraulic cylinders affixed to the inclined plane in a fashion allowing angular movement, and a pair of steps one of each hung from the cylinder rods moving freely on the inclined plane and moveable in a generally inclined vertical direction to effectuate stair climbing exercise.

14 Claims, 5 Drawing Figures

CLIMBING SIMULATION EXERCISE DEVICE

FIELD OF INVENTION

This invention relates to exercise devices and, more particularly, to exercise that simulates climbing.

BACKGROUND OF THE INVENTION

Present climbing simulation exercise devices were devised to offer improved features over inclined, belted treadmills and other types of exercise machines. The most notable of these are Parsons, U.S. Pat. No. 3,592,466; Olson et al, U.S. Pat. No. 3,529,474; McFee, U.S. Pat. No. 3,970,302; Evans et al, British Patent No. GB 2010101; and DeCloux, U.S. patent application Ser. No. 357,791, filed Mar. 12, 1982. None of these devices can offer performance and features at an extremely low cost of manufacture. Their basic concepts are inherently more costly to produce than the invention herein described because they specify tracks for steps or require more, and more costly, components.

A market research firm, Personal Medical Systems, Inc., estimated that the number of home exercise bicycles sold is currently 1.5 million units for both health and sports applications. The number of bicycles used for health applications is estimated at around 400,000. Units average approximately $400 in price, with the majority of this equipment not being covered by insurance reimbursement. These researchers are emphasizing the point that exercise equipment is often a medical necessity, and that prices are high and exempt from insurance reimbursement. Lower cost exercise bicycles are available but they are apparently not adequate. Climbing simulation as an exercise has inherent advantages over stationary bicycling in regards to effectiveness, time and comfort. If climbing simulation equipment were also inexpensive it would service an unfilled human need.

The multiples of manufacturing cost to selling price for this type of equipment ranges from four to ten. As a result, the cost reductions offered by a trackless device has a significant impact on selling price.

SUMMARY OF THE INVENTION

In one embodiment, the subject trackless stair climbing type exercise device invention has but five components: an inclined plane, a plain piece of sheet metal; two piston cylinders, adaptations of the gas springs produced in volume for hatch back cars; a variable constricting orifice, a standard plumbing store needle valve; a pair of steps with runners or wheels; and a mount that allows the cylinders to hang, and with gravity and guide step movement through, for instance, the use of an angle iron and retaining rings and rubber washers.

The plane is supported on the appropriate incline in one embodiment by a pair of legs. Since the user must be supported during use, a rail is provided and the cylinder/valve interconnections are sufficiently compliant and in one embodiment are made of flexible tubing.

In one embodiment, the tops of the cylinders are interconnected through the utilization of the variable restricted orifice in a conduit between the cylinders such that the amount of time that it takes a given weight individual to descend from an up position to a down position is controlled by the size of the orifice. The amount of exercise per cycle per minute is therefore controlled by the variable orifice. In operation, the person performing the exercise steps on the "up" stair and rides down with the stair until it reaches its bottom of travel which is controlled by the bottoming out of the piston in the cylinder or some other stop mechanism within the cylinder. At this point he steps up to the "up" stair which was previously the "down" stair. The process is then reversed and the user continues his stair climbing-type exercise.

It will be noted that the cylinders are located in an inclined vertical plane and are substantially parallel to each other, with the mounting system being flexible to accommodate a shift of the stairs on the inclined plane in a lateral direction. What has been avoided through the utilization of the inclined plane without the utilization of tracks or guiding devices is that the device can be manufactured in an exceptionally inexpensive manner without materially affecting the type of exercise afforded or the safety in utilizing the device. The stair steps may be provided with wheels or skids, with the lateral movement of the stair steps being only constrained by virtue of the piston rods within the piston cylinders which are resiliently mounted and by the skid or wheel friction on the inclined plane. Since the force of gravity works only in a vertical direction, slight swinging of the stair steps from side to side is not a hinderance to the utilization of the device and is readily accommodated by the flexible mounting of the cylinders which support the stair steps. As such, a climbing simulation exercise device in one embodiment includes an inclined plane and a pair of interconnected hydraulic cylinders affixed in a flexible manner to the inclined plane which allows angular movement of the cylinders with respect to the plane. A pair of steps one each is hung from the cylinder rods, with each step moving freely on the inclined plane in a generally inclined vertical direction to effectuate the stair climbing exercise.

BRIEF DESCRIPTION OF THE DRAWINGS

These and other features of the subject invention will be better understood taken in conjunction with the detailed description and the drawings of which.

DETAILED DESCRIPTION

Figure 1:
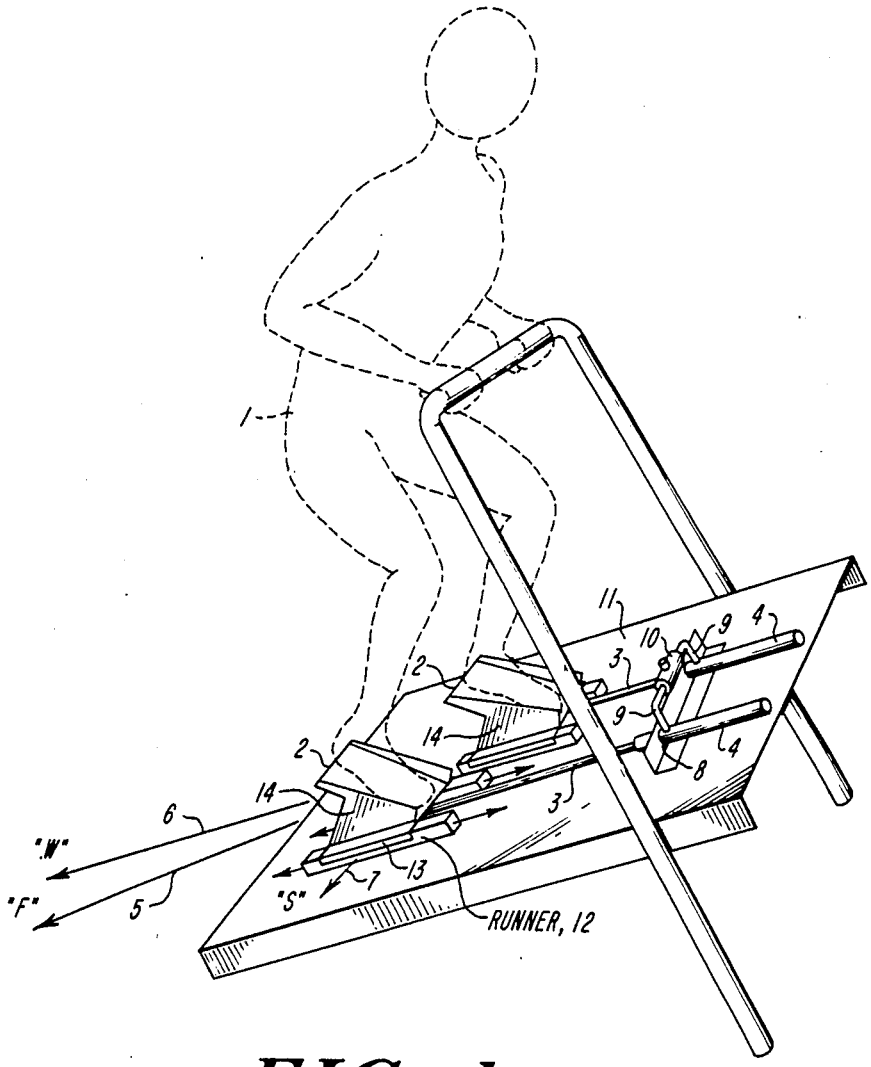
FIG. 1 is a diagrammatic illustraton of the subject climbing simulation exercise device illustrating the five major components.

The subject climbing simulation exercise device provides for complaint accommodation and control of the forces exerted on the device by the user so as to be manufacturable with a minimum of low cost components and at the same time yield desirable product life and performance features. Referring now to FIG. 1, in one embodiment when a user 1 steps onto one of the machine's two steps 2, his weight will cause the step to put cylinder rod 3 in tension. This tension causes the cylinder 4 to line up with the force vector "F" shown by arrow 5 which is the vector sum of the gravity force "W" shown by arrow 6 and the side thrust "S" shown by arrow 7. This lineup is facilitated by the location and compliance of the cylinder mounting 8 and the cylinder/valve interconnections or conduits 9. The tension in the cylinder rod 3 increases the fluid pressure in a fashion described in more detail later on one side of a restricted orifice valve 10. The flow of fluid through the restricting orifice of the valve converts the energy input of the user into heat, raising the fluid temperature. The fluid movement simultaneously converts the energy of the user to heat, couples the steps by causing one step to rise while the other descends, and dissipates the heat to the environment by raising the temperature of the large cylinder surface. The fluid flow allows the weight-bearing step to descend on the inclined plane 11, sliding on its runners 12 attached to a support 14 to which is attached the step. The rate of fluid movement is also determined by the time it takes the step to descend which limits stepping frequency. As such the orifice size controls the exercise intensity.

Figure 2A:
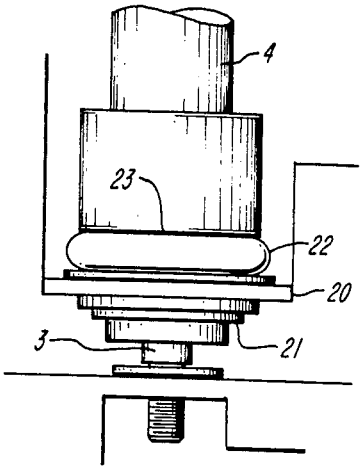
FIGS. 2A, B and C are, respectively, enlarged top and side views of cylinder mounting, a step with runners and its attachment to the associated cylinder, and a side view of the structure of FIG. 2B.

The cylinder mounting system 8 of FIG. 1 is shown in more detail in FIGS. 2A, B and C. In FIG. 2A, the cylinders 4 are secured in this embodiment to a support 20 with a retaining ring 21, rubber compression washer 22, and integral stop and bearing face 23 such that in the unloaded state the compression washer is slightly prestressed so as to hold the cylinder 4 approximately parallel to the inclined plane 11, and approximately in line with gravity. In viewing the vectors "W" of FIG. 1 shown by arrow 6 and "S" shown by arrow 7 operating on the step in FIG. 1, it will be appreciated that "S", side thrust, is small in relation to "W", weight, and as such the angular displacement of the cylinder and step will not be large or disconcerting to the user. It is a feature of the mounting in this embodiment that the mounting will allow small angular displacements, but increasingly resist larger displacements. This action imparts a bending moment on the cylinder rod 3.

Figure 2B:
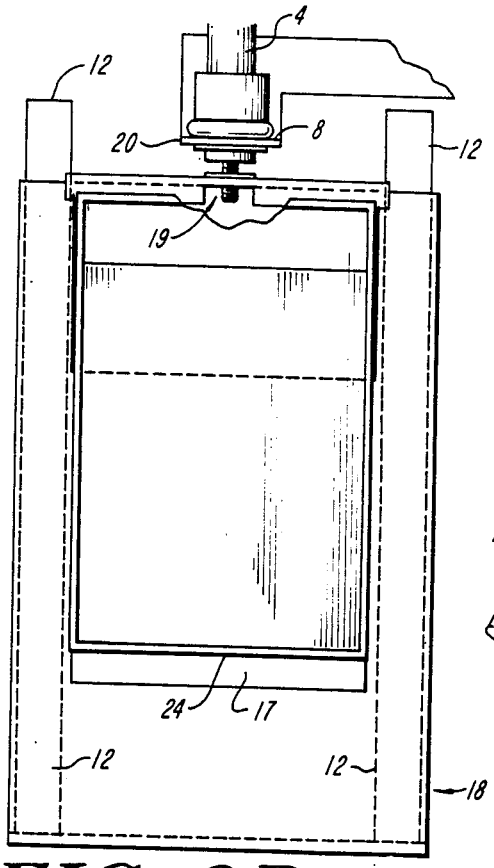

In FIG. 2B it is shown that the step and runners are configured so that, regardless of where on the step platten 24 the user stands, a line through that point normal to the inclined plane falls within the runners. To reduce friction the runenrs have a low coefficient of friction. They could of course be replaced by wheels without impact on the inherent advantages of the design.

Figure 2C:
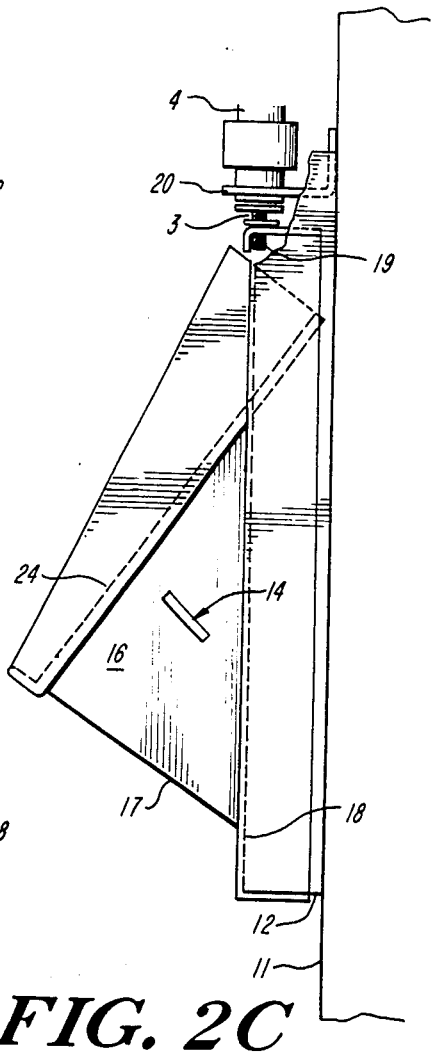

FIG. 2C is a side view of the apparatus of FIG. 2B showing the step support 14 having a side wall 16 and a front wall 17 secured to a flat-topped cover 18 which overlies runners 12 and is coupled to piston rod 3 at point 19 by suitable means.

Figure 3:
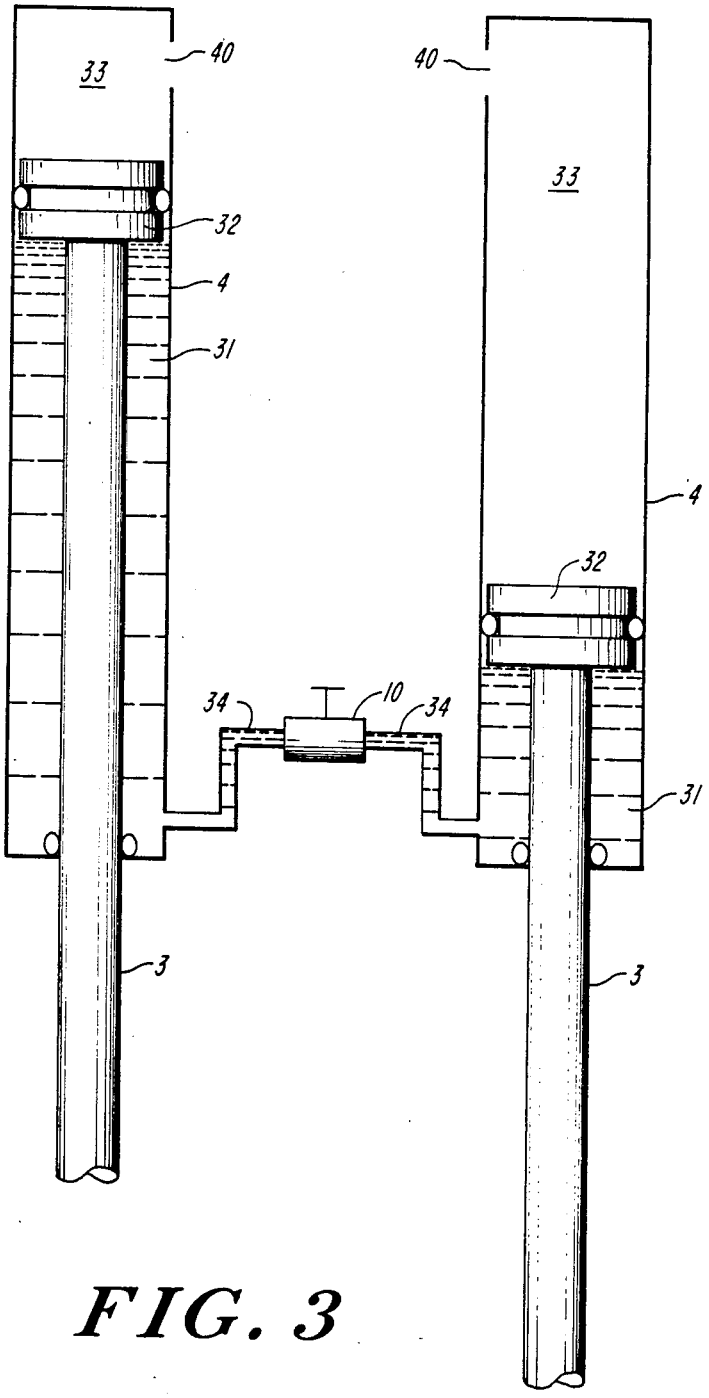
FIG. 3 is a schematic illustration of the cylinders, valve and their interconnection, illustrating the porting and compliance necessary to facilitate self-aligning operation.

FIG. 3 details the cylinder requirements which are necessary to facilitate the self-tracking. To displace fluid 31 and tension in cylinder rod 3, each cylinder 4 is equipped with a sealed piston 32 and there is a fluid below the pistons. The device may use piston cylinders in an open mode where portions 33 of the cylinders 4 are open to the atmosphere at orifices 40 or in a closed mode where cylinder portions 33 of the cylinders are interconnected. This allows cost/featire tradeoffs such as easy step height adjustment, piston fluid leakage reclaiming and reduced thermal impact on stroke length during exercise. Note that the interconnection conduits 34 must be compliant enough to allow cylinder angular displacement without undue force. Note also that variable restricted orifice valve 10 is positioned between conduits 34.

Having above indicated a preferred embodiment of the present invention, it will occur to those skilled in the art that modification and alternative can be practiced within the spirit of the invention. It is accordingly intended to define the scope of the invention only as indicated in the following claims:

What is claimed is:

1. A trackless, self-aligning, exercise device, comprising:

a frame having a substantially flat unobstructed inclined plane surface;

a pair of piston cylinders, each having a rod end and a piston extendable from the rod end, and a mounting end portion opposite to the rod end;

means for resiliently attaching the mounting end portion of each cylinder to the frame, in a position in relation to the inclined surface for disposition of the piston downwardly from the mounted cylinder and along the inclined plane surface and to permit angular movement of the cylinder and piston relative to the attaching means;

a step attached to the distal end of each piston rod and freely slideable on the inclined plane surface along any direction within that surface;

means for hydraulically interconnecting said cylinders such that the movement of the piston in one cylinder in one direction causes the movement of the other piston in the opposite direction, whereby foot pressure on the uppermost step causes downward movement of that step along the inclined plane surface, and causes upward movement of the other step along the inclined plane surface; and each cylinder and piston having a nominal position from which each can be angularly deviated in response to pressure applied to the attached step.

2. The trackless, self-aligning, exercise device of claim 1 wherein said mounting means further includes means for resiliently mounting said cylinders such that increasing angular displacement is met with an increasing restoring force.

3. The trackless, self-aligning, exercise device of claim 2 wherein said resilient mounting means permits limited lateral movement of said steps over said inclined plane.

4. The trackless, self-aligning, exercise device of claim 1 wherein said cylinders are positoned parallel to one another in an inclined vertical direction and wherein the primary movement of said steps during a stepclimbing usage is in a generally vertical direction established by the cylinder rods, said vertical inclined direction being established primarily by the weight of the user as the user utilizes the device for stepping on one step and then the other.

5. The trackless, self-aligning, exercise device of claim 1 and further including means for limiting the stroke of the rods of each of said cylinders such that the downward movement of a step has a lower limit.

6. The trackless, self-aligning, exercise device of claim 5 wherein said control means includes means associated with the hydraulic interconnection of said pair of piston cylinders for controlling the flow of fluid between said pair of piston cylinders.

7. The trackless, self-aligning, exercise device of claim 6 wherein said control means includes an interconnecting conduit having a restricted orifice therein.

8. The trackless, self-aligning, exercise device of claim 1, further including means for restoring the cylinders to their nominal position.

9. The trackless, self-aligning, exercise device of claim 8, wherein said restoring means includes a rubber compression washer disposed between said attaching means and each of said cylinders.

10. The trackess, self-aligning, exercise device of claim 1, further including thrust absorbing means for absorbing said lateral force components of the tension applied to said steps, and therewith for imparting resistance to the angular movement of the cylinders to either side of the nominal position.

11. The trackess, self-aligning, exercise device of claim 10, wherein said thrust-absorbing means includes a rubber compression washer disposed between said mounting means and each of said cylinders.

12. The trackless, self-aligning, exercise device of claim 1, further including contacting means mounted to each of said steps for providing bearing contact with a selected lateral friction characteristic with a confronting surface of said inclined plane and movement relative thereto.

13. The trackless, self-aligning, exercise advice of claim 12, wherein said contacting means includes wheels.

14. The trackless, self-aligning, exercise device of claim 12, wherein said contacting means includes runners.

* * * * *

UNITED STATES PATENT AND TRADEMARK OFFICE

CERTIFICATE OF CORRECTION

PATENT NO. : 4,685,666

DATED : August 11, 1987

INVENTOR(S) : Richard J. DeCloux

It is certified that error appears in the above-identified patent and that said Letters Patent is hereby corrected as shown below:

Column 2,
line 57, "complaint" should read --compliant--

Column 3, line 41, "runenrs" should read --runners--
line 58, "cost/featire" should read --cost/feature--

Column 4, line 47, "stepclimbing" should read --step-climbing--
line 50, "for stepping" should read --by stepping--

Column 5, line 4, "thrust absorbing" should read --thrust-absorbing--

Column 6, line 7, "advice" should read --device--

Signed and Sealed this

Thirteenth Day of December, 1988

*Attest:*

*Attesting Officer*

DONALD J. QUIGG

*Commissioner of Patents and Trademarks*